US005645024A

United States Patent [19]

Allen et al.

[11] Patent Number: 5,645,024

[45] Date of Patent: Jul. 8, 1997

[54] CAMSHAFT END-PLAY ADJUSTMENT DEVICE

[75] Inventors: Timothy R. Allen, Paris; Matthew A. Tompkins, Russellville, both of Ark.

[73] Assignee: Cloyes Gear & Products, Paris, Ark.

[21] Appl. No.: 548,872

[22] Filed: Oct. 26, 1995

[51] Int. Cl.[6] ..... F01L 1/02; F01M 9/10

[52] U.S. Cl. ..... 123/90.38; 123/90.31; 123/195 C; 123/198 E

[58] Field of Search ..... 123/90.31, 90.38, 123/90.6, 195 C, 198 E

[56] References Cited

U.S. PATENT DOCUMENTS

| | | | |
|---|---|---|---|
| 1,520,942 | 12/1924 | Garrett | 123/90.38 |
| 2,474,980 | 7/1949 | Karl | 384/397 |
| 2,701,845 | 2/1955 | Gallagher et al. | 310/90 |
| 3,161,447 | 12/1964 | Larsson | 384/425 |
| 4,261,310 | 4/1981 | Laws, Jr. | 123/198 E |
| 4,538,560 | 9/1985 | Alden | 123/90.38 |
| 4,607,601 | 8/1986 | Kohler | 123/90.31 |
| 4,608,950 | 9/1986 | Payne et al. | 123/195 C |
| 4,719,892 | 1/1988 | Lopez-Crevillen | 123/198 E |
| 4,867,335 | 9/1989 | Segal | 123/198 E |
| 5,000,142 | 3/1991 | Aruga et al. | 123/195 C |
| 5,010,855 | 4/1991 | Ogami et al. | 123/90.31 |
| 5,010,859 | 4/1991 | Ogami et al. | 123/195 C |
| 5,095,880 | 3/1992 | Newell | 123/90.38 |
| 5,174,169 | 12/1992 | Allen | 74/395 |

*Primary Examiner*—Weilun Lo

*Attorney, Agent, or Firm*—Fay, Sharpe, Beall Fagan, Minnich & McKee

[57] ABSTRACT

A timing chain cover which is mounted to an engine block having an opening in general axial alignment with an exposed end of a camshaft. A cap is mounted to the cover and generally seated in the opening. The cap includes a hole in general axial alignment with the camshaft and an adjustable button is secured in the hole. One end of the button engages the camshaft to prevent cam walk and opposed end is accessible for adjustment without removal of the cover from the engine block.

12 Claims, 5 Drawing Sheets

CAMSHAFT END-PLAY ADJUSTMENT DEVICE

BACKGROUND OF THE INVENTION

1. Field of the Invention

This invention relates to an assembly for preventing camshaft axial movement, commonly referred to as "cam walk" or "camshaft end-play". More particularly, this invention relates to a camshaft timing gear cover including a mechanism which prevents camshaft end-play and allows easy adjustment of the camshaft end-play.

The timing gear cover assembly of the present invention is particularly well-suited for use with internal combustion engines having a drive sprocket or gear which provides valve timing between the camshaft and the engine crank shaft. Throughout the specification, reference will be made to the use of the assembly in internal combustion engines of this design, however, it should be realized that the invention could be utilized in a variety of engines wherein camshaft end-play is a concern and an ability to rapidly adjust end-play is desirable.

DESCRIPTION OF THE ART

It has been previously recognized that a need exists for rapid and uncomplicated angular adjustment of the drive sprocket or gear of an engine camshaft. For example, U.S. Pat. No. 5,174,169, herein incorporated by reference, discloses a device for adjusting the angular position of a camshaft drive member. Particularly, the drive member, connected by chain or belt to the crankshaft, is mounted on the camshaft for rotation. A cylindrical stud extends from the camshaft into a slotted opening having angularly spaced parallel sides. A freely rotatable eccentric cam fits closely between the parallel sides of the slotted opening. The cam is arranged to permit selected rotation which adjusts the angular position of the drive member relative to the camshaft. While this arrangement has been found very effective in facilitating rapid timing adjustments, this device does not address end-play of a camshaft.

In contrast, U.S. Pat. No. 4,261,310 is directed to the inclusion of a cam walk prevention device. The patent specifically discloses a camshaft and timing chain cover assembly including a rigid spacer member. In a preferred embodiment, the dimension between the end of the camshaft and a low friction bearing (a thrust button) of the spacer member can be adjusted. However, a significant deficiency exists in this design because the spacer member is only adjustable internally to the camshaft cover plate. More particularly, removal of the entire cover plate is necessary to adjust the position of the thrust button. Accordingly, the design of U.S. Pat. No. 4,261,310 does not allow rapid adjustment of the end-play tolerance.

As made apparent by the above discussion, it would be desirable in this art to have a camshaft end-play prevention mechanism which is readily adjustable without the investment of extensive time by a mechanic to remove the camshaft cover.

SUMMARY OF THE INVENTION

Accordingly, it is an object of this invention to provide a new and improved mechanism for preventing camshaft end-play.

It is an advantage of this inventive mechanism to provide an accessible camshaft end-play adjustment device.

Yet another advantage of this inventive mechanism is the prevention of camshaft end-play without compromising the ability to easily adjust angular position of the camshaft drive member.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the foregoing objects in accordance with the purpose of the invention, as embodied and broadly described herein, the camshaft end-play adjustment mechanism of this invention comprises a cover assembly which shields the timing drive linking a camshaft and a crankshaft. The cover assembly includes a cover member mounted to the engine block surrounding the timing drive. The cover member includes an opening in axial alignment with the exposed end of the camshaft. A cap member is secured to the cover member, preferably sealing the opening which otherwise exposes the camshaft end. The cap member also includes a hole, generally in axial alignment with the exposed end of the camshaft. Secured within the hole is an button having an end engaged in said hole and an end engaging the camshaft. The end secured in the hole is outwardly exposed to allow axial adjustment of the button. Preferably, the exposed end is slotted or otherwise shaped to accommodate a screwdriver or wrench. In this manner, the tolerance for camshaft end-play can be adjusted, without removal of the cover assembly or cap member, by adjusting the position of the button toward or away from the camshaft.

Preferably, the adjustable camshaft button is comprised of a body portion and a shoulder ("cam roller"), integral thereto or as a separate but secured piece, at its end disposed toward the cam. Preferably, the shoulder is a separate piece comprised of steel, secured to the body portion of the button by a lock washer. Preferably, such an arrangement also includes at least one bearing element positioned between the adjustable body portion of the button and the shoulder. In a further preferred embodiment, the body portion of the adjustable button is threadedly engaged in the hole of the cap member. In an additional preferred embodiment, the exposed end of the body portion of the adjustable button includes a threaded recess accommodating a locking screw. As those skilled in the art will recognize, the cover plate and cap member are preferably constructed of a high strength material, such as aluminum, steel, high modulus plastic, or composites thereof, to provide an appropriate load bearing surface for the camshaft.

BRIEF DESCRIPTION OF THE DRAWINGS

The above and other objects and advantages will become apparent from the following description when read in conjunction with the accompanying drawings.

DETAILED DESCRIPTION OF THE PREFERRED EMBODIMENT

Figure 1:
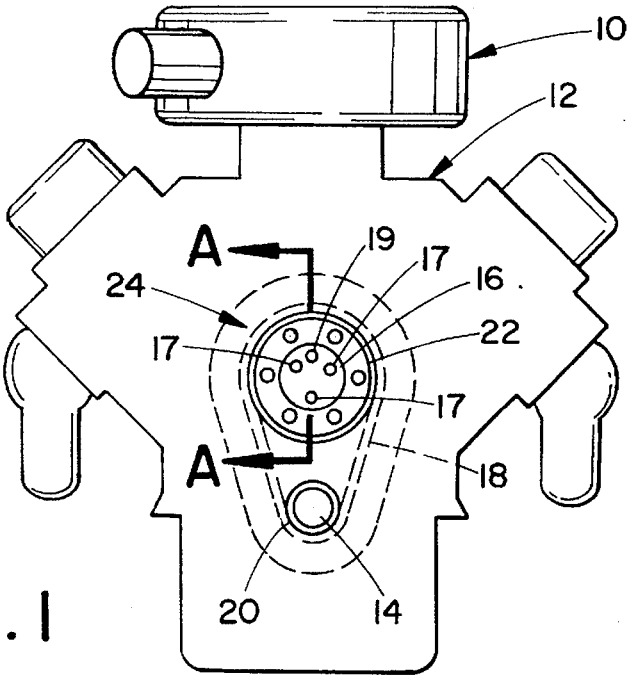
FIG. 1 is an end view of an engine suited to use of the inventive camshaft cover assembly.
Figure 2:
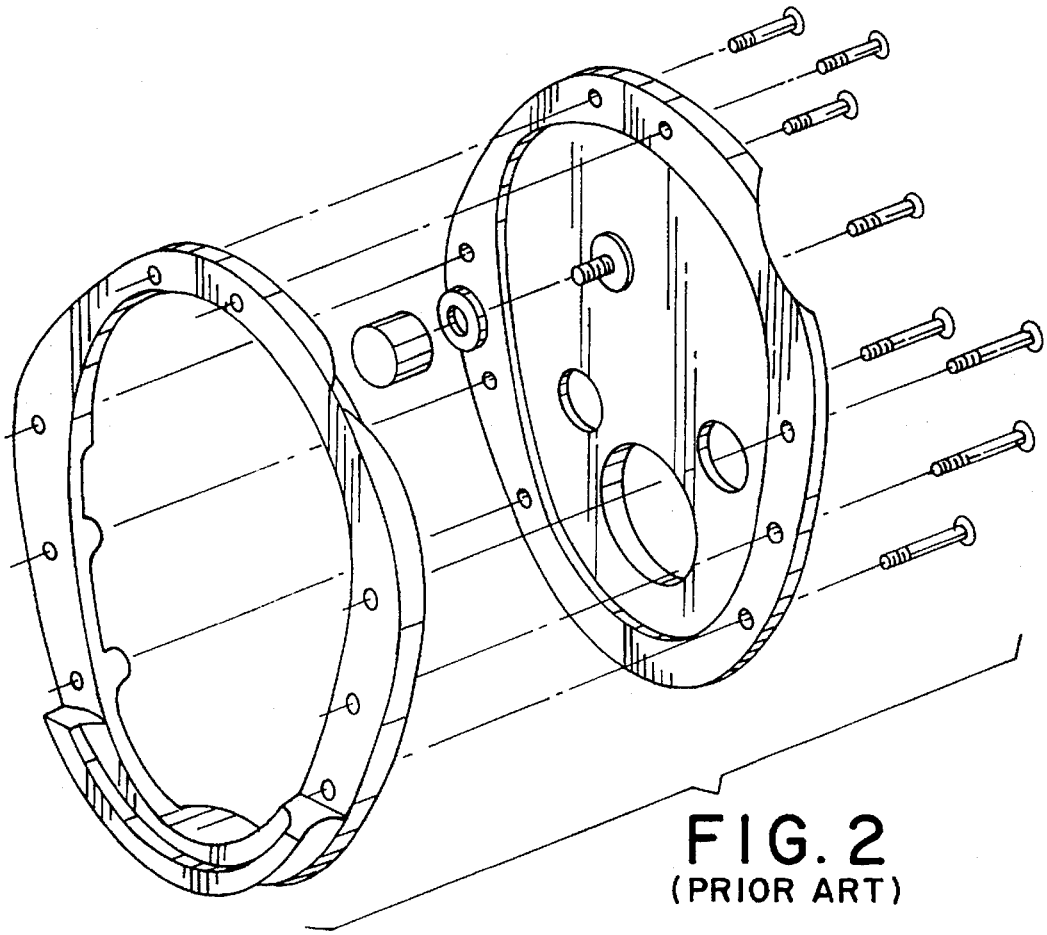
FIG. 2 (PRIOR ART)
FIG. 2 is a perspective view which illustrates the prior art camshaft walk button of U.S. Pat. No. 4,261,310, accessible only by removal of the cover assembly.

Throughout the specification, like elements of the assembly are depicted with like numbers. Referring more particularly to the drawings, wherein the showings are for purposes of illustrating the preferred embodiments of the invention only, and not for the purpose of limiting same, FIG. 1 shows the general arrangement of an internal combustion engine indicated by 10. Preferably, the cover device of the present invention includes an opening which is sized appropriately to allow access to the angular adjustment mechanism of U.S. Pat. No. 5,174,169 which is a preferred camshaft drive member design for use in combination with the present end-play adjustment device. The engine is illustrated as being of a type including an engine housing 12 which includes a V-type cylinder block. The housing 12 contains a crankshaft 14 and a camshaft 16 which are interconnected in the usual manner by a positive drive cogbelt 18, shown here only in dashed lines, extending between a drive gear or sprocket assembly 20 on the crankshaft 14 and a driven gear or sprocket 22 on the camshaft 16. A camshaft bearing 21 is located between the engine block 12 and the camshaft 16. The driven sprocket 22 is adjustably mounted to the camshaft 16 by a plurality of threaded bolts 17 and a cam adjustment member 19. It should be appreciated that the invention is equally applicable to other types of drive mechanisms including chain type drive connections. In fact, the invention is applicable to any engine including an exposed camshaft.

Also depicted in dashed outline is the position of the cover assembly 24, which is the subject of the present invention. In a preferred embodiment, the cover assembly of the present invention is utilized in combination with the camshaft angular adjustment drive member depicted here and more fully described in U.S. Pat. No. 5,174,169, herein incorporated by reference.

Figure 3:
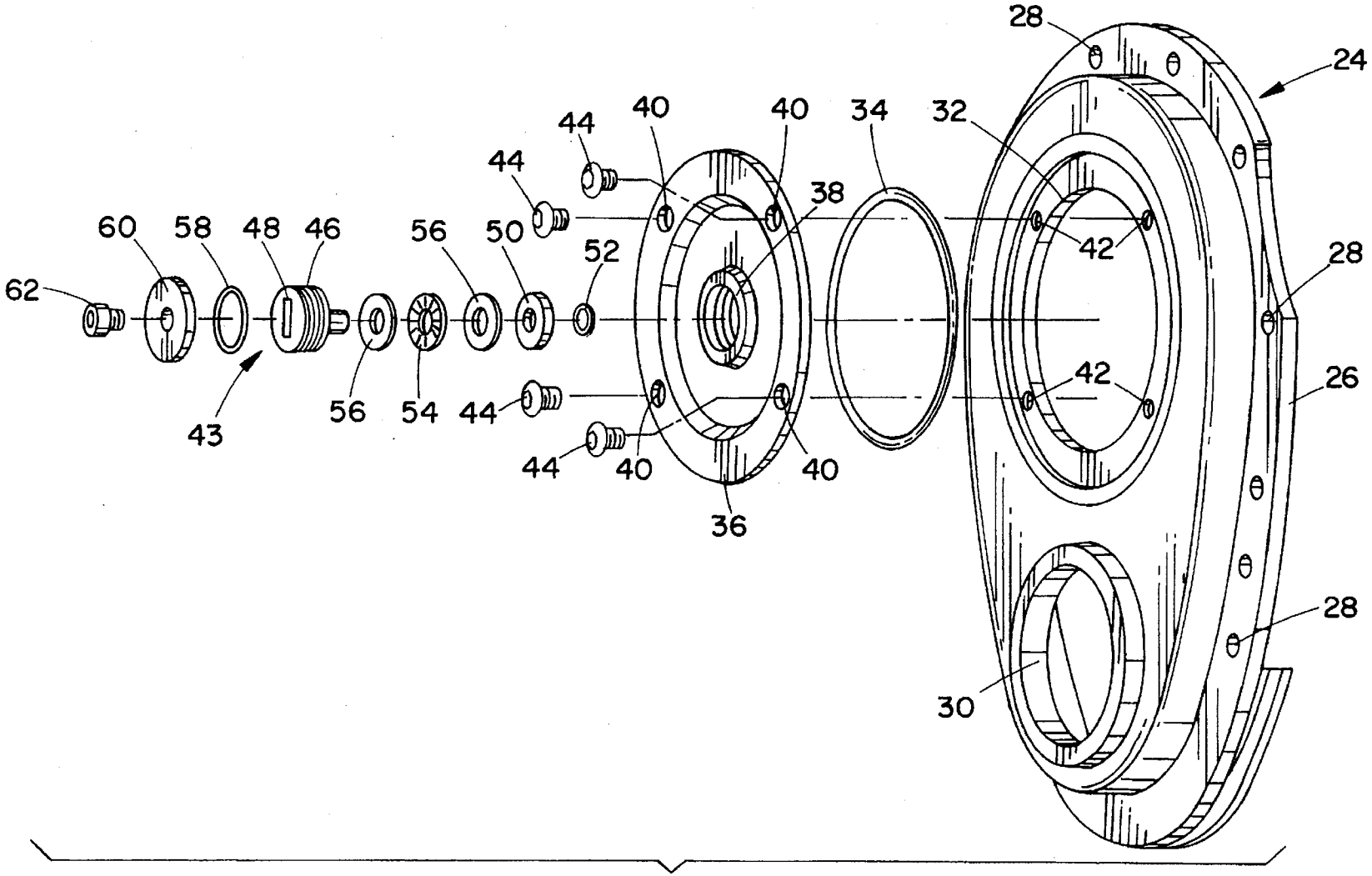
FIG. 3 is a perspective view of one embodiment of the subject invention.
Figure 4:
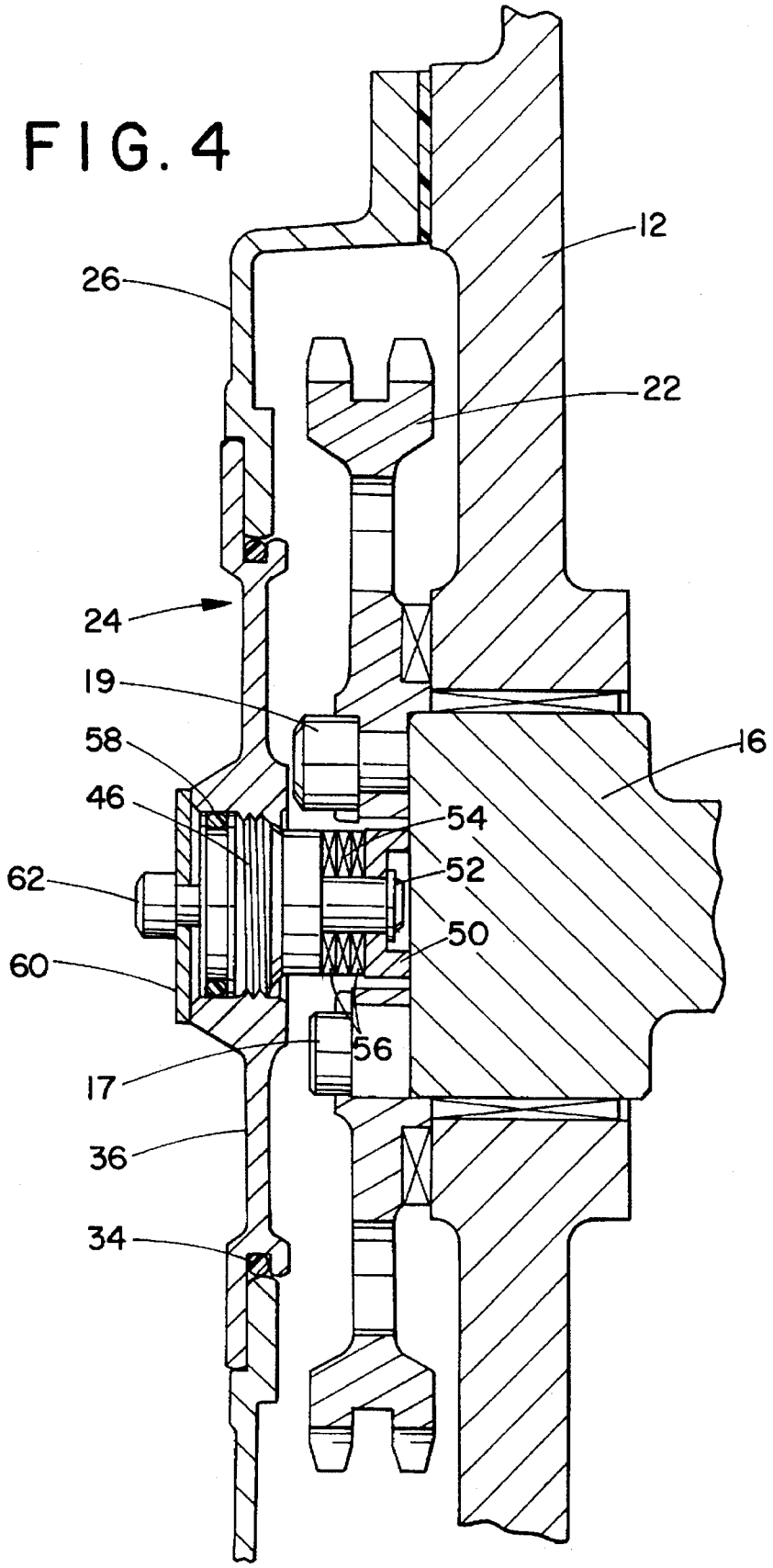
FIG. 4 is a cross-sectional view of the embodiment depicted in FIG. 3 shown generally from the perspective of line A—A of FIG. 1.

Referring now to FIGS. 3 and 4, the preferred cover assembly 24 is shown. As seen in the figures, the cover assembly consists of a first timing drive cover plate 26 including a plurality of peripheral holes 28 provided to allow bolted engagement (not shown) to engine block 12. Timing cover plate 26 also includes a first hole 30, which in a mounted position, is axially aligned with drive shaft 14 and a second hole 32 which is axially aligned with camshaft 16. Positioned within hole 32 is gasket 34 and cap 36 including a centrally located bore 38 and a plurality of peripheral holes 40 aligned with threaded holes 42 in cover plate 26 to provide attachment of cap 36 via screws or bolts 44. Adjustable button 43 is secured within bore 38. The adjustable button 43 is comprised of a body 46 having a threaded head portion and a cylindrical tail portion. Threaded head portion also includes a slot 48 for adjustment by screwdriver. As depicted, threaded head portion 46 mates with the internal threads of hole 38 in cap 36. Secured to the tail portion of adjustable button 43 is a cup shaped cam roller 50, preferably comprised of steel. Cam roller 50 is secured to button adapter 46 via a lock washer/retaining ring 52 yet allowed to rotate relative to a bearing surface provided by races 56 (hardened washers) and a bearing 54, which also create a resilient interface with the camshaft. Finally, adjustable button 43 is secured into position via gasket 58, washer 60 and locking screw 62.

Figure 5:
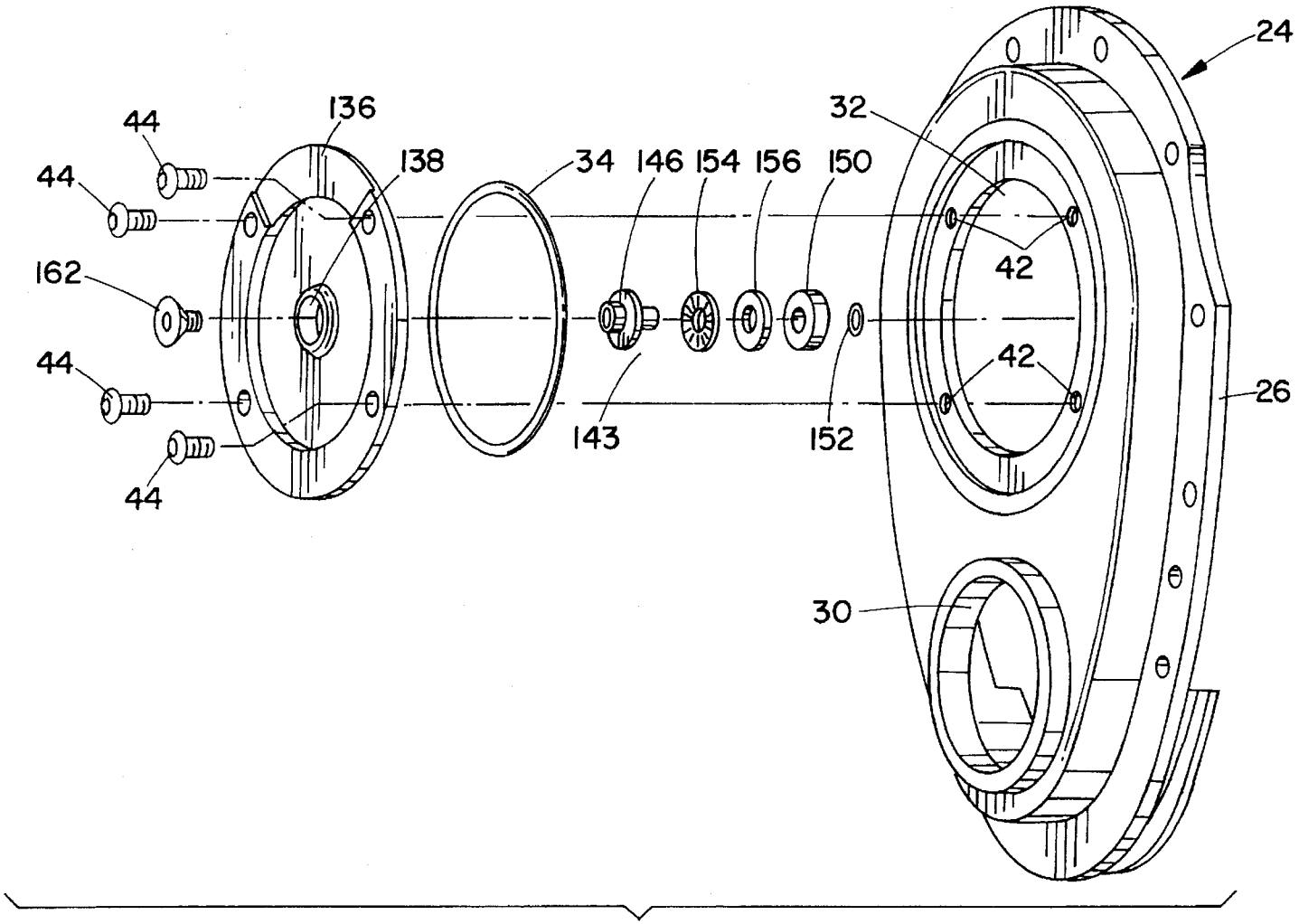
FIG. 5 is a perspective view of an alternative embodiment of the present invention.
Figure 6:
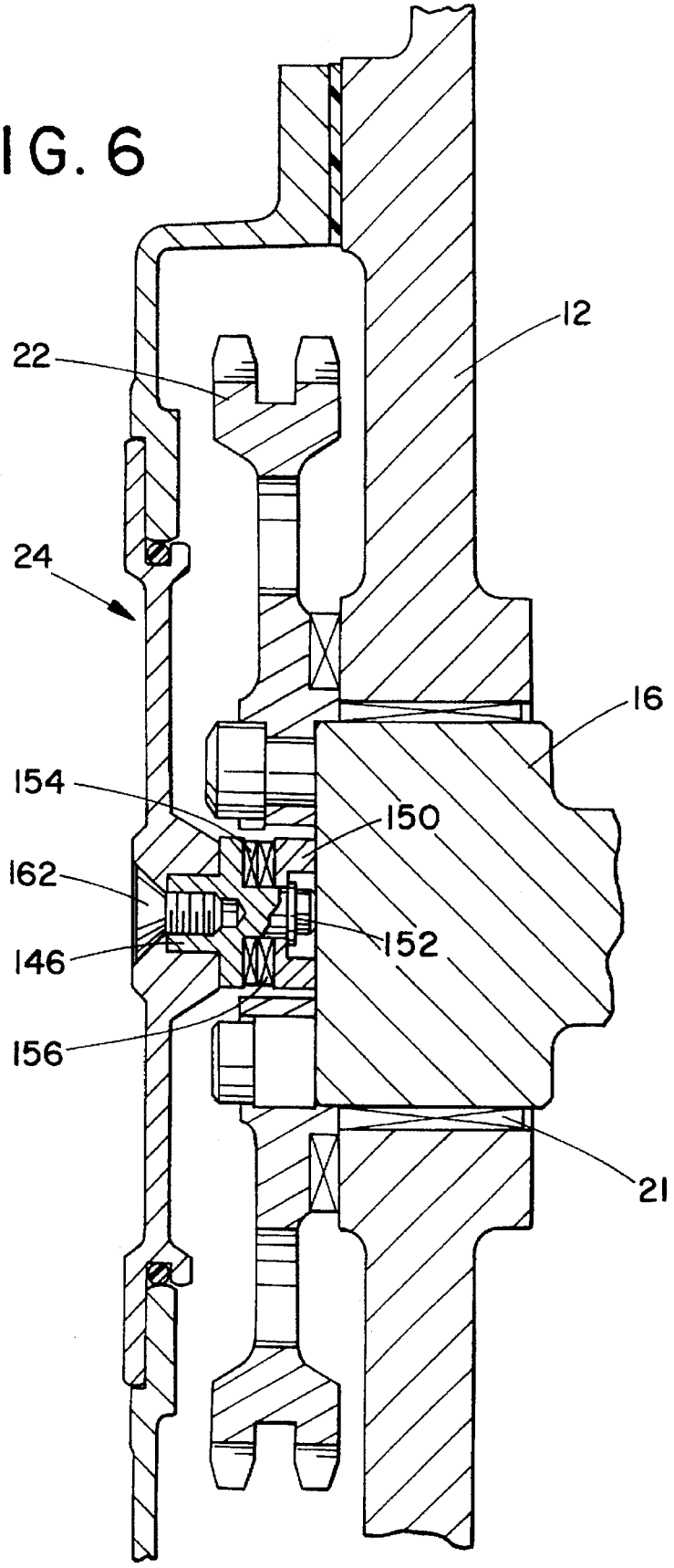
FIG. 6 is a cross-sectional view of the embodiment depicted in FIG. 5 shown generally from the perspective of line A—A of FIG. 1.

Referring now to FIGS. 5 and 6, a particularly preferred embodiment of the invention is depicted. Again, cover plate 26 includes hole 30 in axial alignment with the crankshaft and hole 32 in axial alignment with the camshaft.

Furthermore, a gasket 34 is again positioned between cap 136 and cover plate 26, cap 136 being retained by a plurality of screws 44 threadedly engaged in holes 42 of cover plate 26.

In this embodiment, camshaft end-play is limited by adjustable button 143 having body portion 146 including a threaded head, a central larger circumference middle portion and a cylindrical tail portion. As in the prior embodiment, cup shaped cam roller 150 is secured to the tail of the body 146 by lock washer or retaining ring 152. In addition, a bearing 154 and a race 156 provide appropriate spacing and resiliency between body 146 and cam roller 150. As in the prior embodiment, a locking screw 162 is inserted into the threaded head portion of the adjustable button 143. In this embodiment the locking screw 162 includes a canted head matable to the canted walls of hole 138 to provide frictional engagement which securely positions adjustable button 143.

Thus, it is apparent that there has been provided, in accordance with the invention, a mechanism for camshaft end-play prevention that fully satisfies the objects, aims and advantages set forth above. While the invention has been described in conjunction with specific embodiments thereof, it is evident that many alternatives, modifications and variations will be apparent to those skilled in the art and like the foregoing description. Accordingly, it is intended to raise all such alternatives, modifications and variations as they fall within the spirit and broad scope of the appended claims.

What is claimed:

1. In an internal combustion engine having an engine block and an output shaft connected by a timing drive to a camshaft, a cover assembly comprising:

a cover member surrounding said timing drive and mounted to said engine block, the cover assembly including an opening in general axial alignment with an exposed end of the camshaft, a cap member mounted to the cover member and generally seated in said opening, said cap member including a hole in general axial alignment with said camshaft, an adjustable button having a first end secured in said hole and a second end engaging said camshaft, said first end being accessible for adjustment without removal of the cover assembly.

2. The cover assembly of claim 1 further including a hole for receiving an output shaft extremity.

3. The cover assembly of claim 1 wherein said adjustable button is comprised of a cam roller in a bearing relationship with said camshaft and a body portion secured to said cap member.

4. The cover assembly of claim 3 wherein at least one bearing is positioned between said cam roller and said body portion.

5. The cover assembly of claim 1 wherein said adjustable button is threadedly engaged in the hole of said cap member.

6. The cover assembly of claim 1 wherein said adjustable button is secured in place by a locking screw.

7. The cover assembly of claim 1 wherein at least said cover member and said cap are comprised of a high strength material.

8. A cover assembly for a camshaft and timing drive comprised of a body shaped to at least partially enclose said timing drive, Said body including a side mountable to an engine block and a threaded bore extending from said mountable side to an opposed second side, a button having a first elongated portion threaded in said bore and a second end projecting from the mountable side of said body to provide a cam roller bearing surface with said camshaft, said first elongated portion providing an end which is exposed at the opposed second side of said body to permit adjustment thereof.

9. The cover assembly of claim 8 wherein said body portion is comprised of two matable pieces, a first piece forming the periphery of said cover and a second piece removably mounted to said first piece, said bore being formed in said second piece.

10. The cover assembly of claim 8 wherein at least one bearing is positioned between said cam roller and said elongated portion.

11. The cover assembly of claim 8 wherein said adjustable button is secured in place by a locking screw.

12. In an internal combustion engine having a timing drive cover assembly comprised of a main body having a recessed side formed to at least partially house the timing drive, at least one opening being formed in said cover, a cap member shaped to removably mount in said opening, said cap member including a threaded bore, an adjustable button threaded in said bore, said button comprised of a threaded head portion adjustably positioned in said bore and a second cylindrical portion, a doughnut shaped element being secured to said cylindrical portion in a manner which allows rotation of said element, at least one bearing located on said cylindrical portion between said doughnut element and said threaded head portion.

* * * * *